United States Patent [19]

Tai-Cheng

[11] Patent Number: 4,743,214

[45] Date of Patent: May 10, 1988

[54] STEERING CONTROL FOR TOY ELECTRIC VEHICLES

[76] Inventor: Yang Tai-Cheng, 14, Lane 616, Chang-Teh Rd., Taipei, Taiwan

[21] Appl. No.: 903,256

[22] Filed: Sep. 3, 1986

[51] Int. Cl.[4] ..... A63H 17/395; A63H 33/26

[52] U.S. Cl. ..... 446/129; 446/436; 180/79.1

[58] Field of Search ..... 446/129, 130, 137, 436, 446/437, 460, 468; 180/79.1, 79

[56] References Cited

U.S. PATENT DOCUMENTS

| | | | |
|---|---|---|---|
| 2,146,708 | 2/1939 | Barrett | 446/436 |
| 3,061,035 | 10/1962 | King | 180/79.1 |
| 3,131,508 | 5/1964 | Brown | 446/436 |
| 3,252,247 | 5/1966 | Miller et al. | 446/436 |
| 4,165,581 | 8/1979 | Wolf | 446/175 |
| 4,471,566 | 9/1984 | Ishimoto | 446/460 X |

*Primary Examiner*—Mickey Yu

*Attorney, Agent, or Firm*—Ostrolenk, Faber, Gerb & Soffen

[57] ABSTRACT

A device for controlling the steering and direction of movement of an electrically operated toy vehicle wherein the toy vehicle has a rear axle driven by a gear train from an electric motor and a worm gear on the rear axle engaging a helical gear. The front wheels are connected by a tie rod and are adjustable together from a normal straight line position to an angular position to cause the vehicle to run in a curved path. An adjusting arm on the helical gear presets the angular position of the helical gear in which a reversal of direction will occur and a plurality of such angular positions may be provided. The direct current source or battery for motor power for the unit includes a pair of electromagnets in circuit with the source of electrical current, which is direct current, and with contact members. Energization of one of the electromagnets will, through a link, connection to the tie rod, cause the front wheels to turn in one direction. Energization of the other electromagnet will turn the front wheels in another direction. A spring connected to the link and tie rod for normalizing the position of the tie rod causes the front wheels to be directed straight ahead. The electromagnets, the direct current power source, such as a battery, and contact members are placed in series with each other.

11 Claims, 4 Drawing Sheets

STEERING CONTROL FOR TOY ELECTRIC VEHICLES

FIELD OF THE INVENTION

The present invention is related to steering control for toy electric vehicles and, in particular, to a drive device that uses electric power to control the left/right positions of the front wheels of the toy vehicle and thereby to instantly change the travel direction of the vehicle to make the travel route of the toy vehicle follow a pre-programmed path set by the user.

BACKGROUND OF THE INVENTION

Currently, conventional electric toy vehicles often do not have any fixed rails. When their power supply is turned on, they would therefore travel in a straight line or in loops with fixed patterns without any changes. This produces a result which becomes monotonous and dull, and gradually becomes unacceptable to most children. In addition, children cannot use their own ideas to make the toy vehicles travel according to their concepts. Such toy vehicles therefore lack the proper actions to exercise and reinforce the children's intelligence and trigger their ingenuity and creativity.

OBJECTS OF THE INVENTION

The principal object of the present invention is to overcome the defects of the above-cited conventional toy vehicles and to provide an automatic control drive device for an electric toy vehicle to make it travel along the users' set zigzag routes through automatic control. The routes the vehicle will run are entirely subject to the users' choices.

The secondary object of the present invention resides in the travel direction adjustment device of the automatic control, so that it can make proper adjustments in the travel routes selected by the users to make the travel routes of the electric toy vehicle fall within the users' expectations and also to form new lines of travel. By this means, the present invention fully exercises and reinforces the children's intelligence and ingenuity.

SUMMARY OF THE INVENTION

An automatic drive device of the electric toy vehicle is composed of a power motor, a gear set, an annular helical gear, a reverse device, front wheel turn mechanism and a toy vehicle chassis. The power motor is connected to and drives the gear wheel. The gear wheel transmits motive power to the rear wheel shaft of the chassis of the electric toy vehicle and makes the toy vehicle move forward. A worm at the end of a rotatable rod is inserted in the annular helical gear which is pivoted to the chassis of the toy vehicle with a multi-direction adjustment device on the perimeter of the annular worm wheel. The multi-direction adjustment device is to adjust and obtain the required directions by means of controlling the electric conductive polarity of the brush contact. This, in turn, controls the electric conductivity of the circuit to make the reverse device generate reverse movements. The multi-direction adjustment device also controls the left/right turn and straight forward travel of the front wheels.

BRIEF DESCRIPTION OF THE DRAWINGS

The foregoing and other objects of this invention will become apparent in the following description and drawings in which.

SPECIFIC DESCRIPTION

Figure 1:
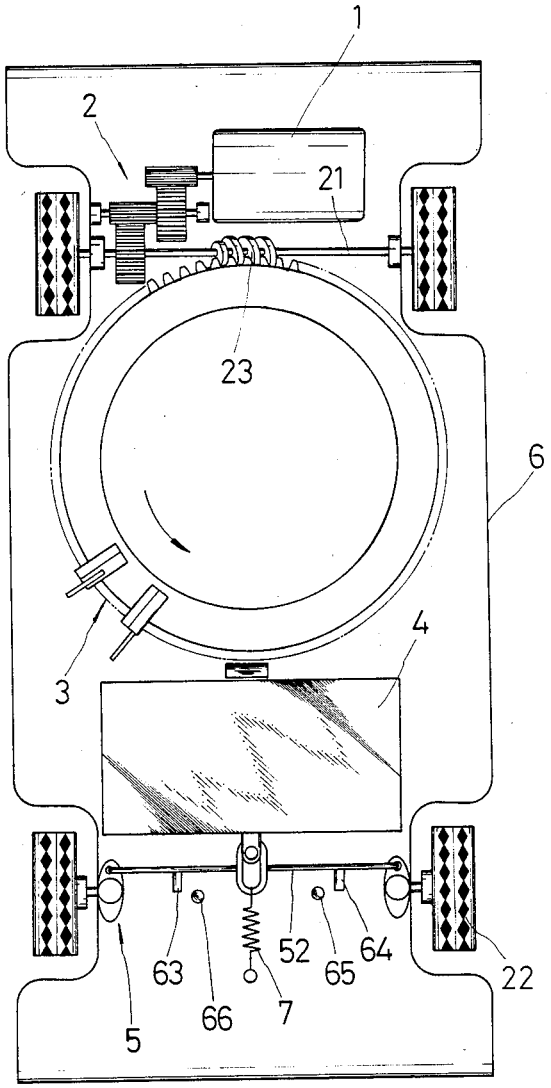
FIG. 1 is a top view of a structure embodying the present invention joined to the chassis of the electric toy vehicle of the present invention.

Referring to FIG. 1, the device of the present invention comprises a power motor 1, a gear set 2, an annular helical gear 3, a reverse device 4, a front wheel reverse mechanism 5, and a chassis of the toy vehicle 6. The power motor 1 drives the gear set 2. The gear set drives the rear wheel shaft 21 carried by the chassis of the toy vehicle 6 to make the toy vehicle move forward. A worm gear 23 in the middle part of the rear wheel shaft 21 engages the annular helical gear 3.

Figure 2:
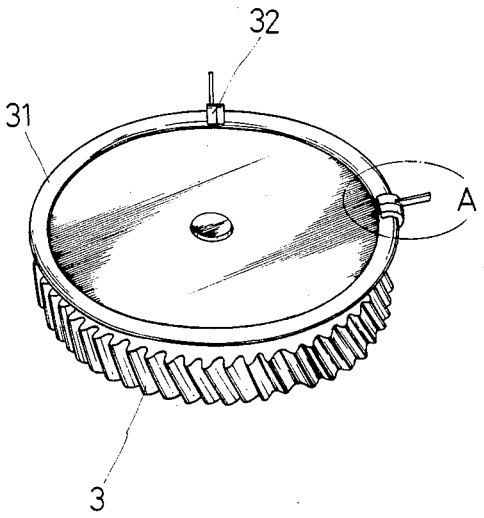
FIG. 2 is a view in perspective of the annular helical gear of the present invention.
Figure 3:
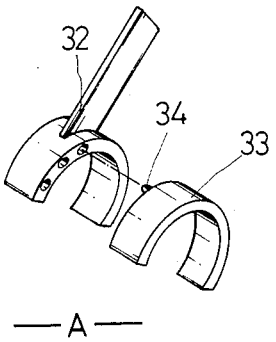
FIG. 3 is an enlarged view of the part A shown in FIG. 2.
Figure 4:
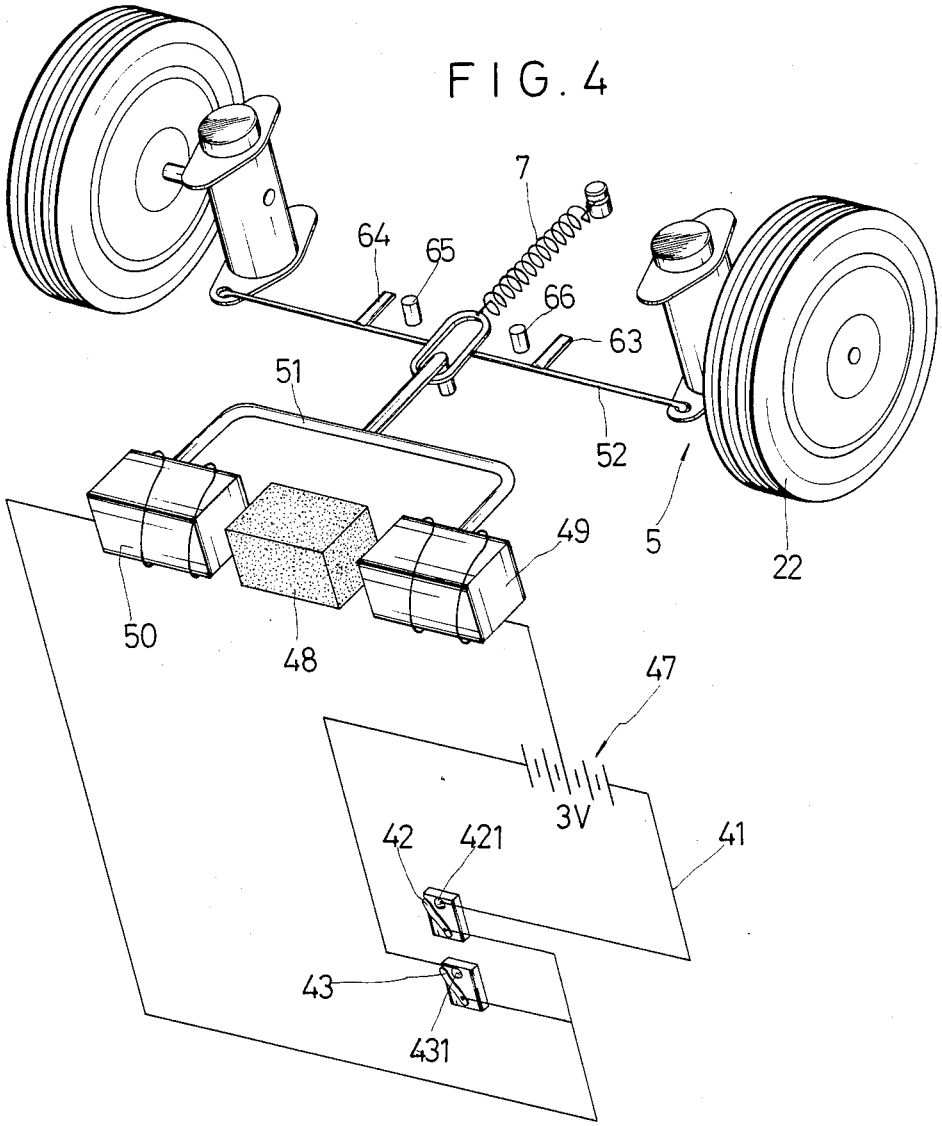
FIG. 4 is a schematic view in perspective of the reverse device including also the electromagnet set of the present invention.
Figure 5:
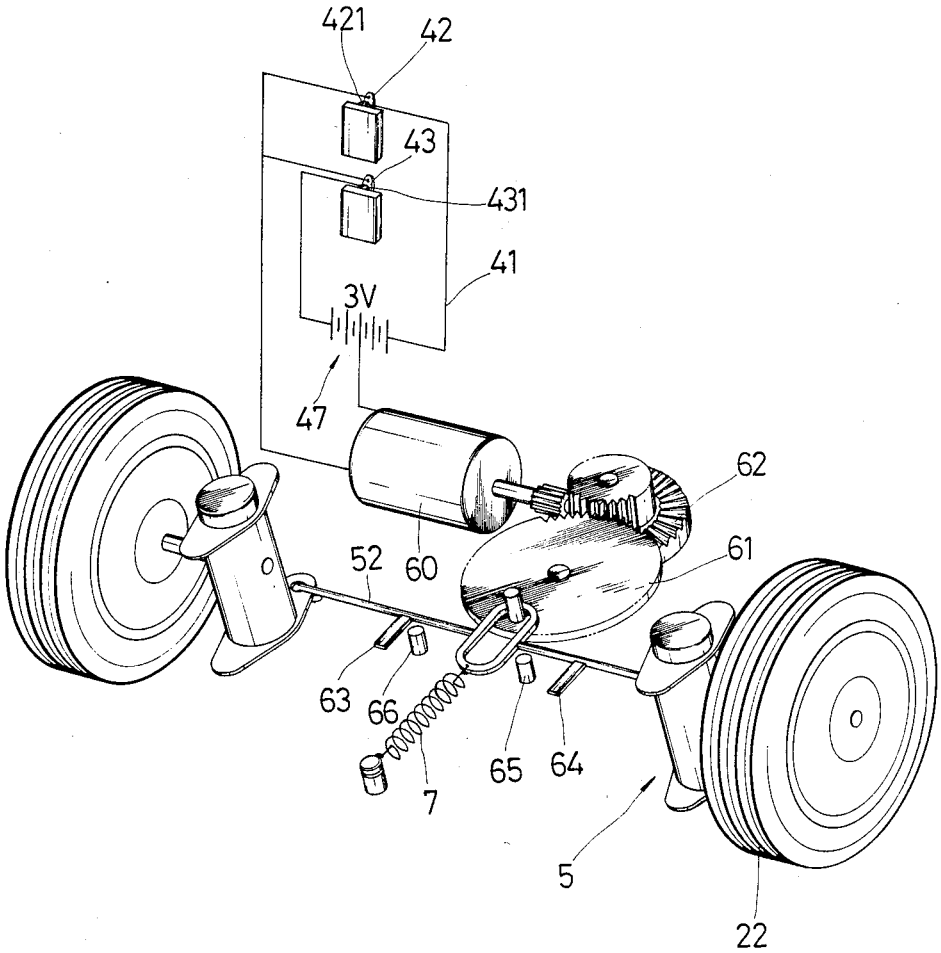
FIG. 5 is a schematic view in perspective of the reverse device and the motor drive of the present invention.

As shown in FIGS. 2 and 3, the annular helical gear 3 is pivoted on the chassis of the toy vehicle 6. A multi-direction adjustment device is applied to the peripheral belt 31 of the annular helical gear 3. This multi-direction adjustment device is lined up by a direct-adjustment rod 32 which is held by a sleeve on the radial stem 33 as a unit. Three (or several) hole positions are applied at equally spaced intervals of 45° on the direction adjustment rod 32 to cooperate with the projecting points 34 of the radial stem 33 for adjusting to three different (or other several different) angles to control the electric conductive polarity of the brushes 42, 43 (as shown in FIGS. 4, 5). The positions of the brushes 42, 43, in turn, control the direction of electric conductivity of the control circuit 41 to make the reverse device 4 produce reverse movements. This results in control of the front wheel 22 left/right turns and straight movements of the front wheels.

As shown in FIG. 4, the battery set 47 is arranged in a series connected circuit 41 including brush elastic plates 42, 43 and four 1.5 V dry batteries. The permanent magnet 48 and two electromagnets 49, 50 are structured as a unit. One end of the electromagnet 49 is connected with the 3 V point of the middle connector of the battery set 47. When the direction adjustment rod 32 is adjusted up to 45°, the brush elastic plate 42 is pressed by the direction adjustment rod 32 to cause the end point 42 to be connected with the negative pole of the battery set 47 through the circuit 41. The electromagnets 49, 50 generate the polarity of S and N at the same time, so the link rod 51 pivotally connected with the electromagnets 49, 50 generate the push force toward the left to make the front wheel turn mechanism 5 immediately turn to the right. When the direction adjustment rod 32 disengages the brush elastic plate 42, the action of the pull-extension spring 7 pivotally connected with the middle part of the transverse shaft 52 restores the toy vehicle immediately to straight travel. When the direction adjustment 32 is adjusted downward to the 45° position, the brush elastic plate 43 is pressed down by the direction adjustment rod 32 to electrically contact the positive pole of the brush elastic plate, thus generating a positive polar electric motive force to make the electric magnets 49, 50 generate the polarity of N and S simultaneously. Therefore, the link rod 51 pivotally connected with the electromagnets 49, 50 generate a push force to the right to make the front wheel turn mechanism 5 immediately turn to the left. When the direction adjustment rod 32 disengages the brush elastic plates 43, the action of the pull extension spring 7 pivotally connected with the middle part of the transverse shaft 52 of the new toy vehicle restores immediately to straight travel.

In the present invention, the brush elastic plates 42, 43 respectively and electrically connect with the negative and positive poles of the battery, with the direction adjustment rod at 45° or at any other positions at the set angles. In one of the positions for the direction adjustment rod, it will not touch the brush elastic plates 42, 43 so that the vehicle will maintain straight travel.

The operating sequence of the present invention is as follows: When the annular helical gear 3 rotates in a direction as shown by the arrow, if the negative pole connected by the upper end point 421 (FIG. 4) of the brush elastic plate 42 electrically contacted by the direction adjustment rod 32 generates a negative polar electromotive force to make the electromagnets 49, 50 generate the polarity of S and N at the same time, then, due to the attractive or repulsive force of the natural magnet 48, the link rod 51 pivotally connected with the electromagnets 49, 50 generates a push force to the left, i.e. the front wheel 22 turn aside to the right. Reversely, if the positive pole connected by the upper end point 431 (FIG. 4) of the brush elastic plate 43 is electrically contacted to the direction adjustment rod 32, this generates a positive polar electromotive force to make the electromagnets 49, 50 generate the polarity of N and S at the same time. Then, due to the attractive or repulsive force of the natural magnet 48, the link rod 51 pivotally connected with the electromagnets 49, 50 generate a push force to the right, i.e. the front wheel 22 turn aside to the left.

When the direction adjustment rod 32 remains at a horizontal position, it will not touch the brush elastic plates 42, 43 after the front wheel 22 turns aside to the right or left. Then the pull extension spring 7 immediately pulls the front wheel 22 back to its original position to keep an undeflected (straight) direction to move forward.

Alternatively, as shown in FIG. 5, the function of the reverse device of the present invention can also be achieved by a motor for the positive and reverse turns. The motor 60 and gears 61, 62 are fixed on a proper position of the chassis of the toy vehicle 6. Both sides of the transverse shaft 52 have the stop plates 63, 64 respectively which cooperate with the stop pins 65, 66 fixed on the chassis of the toy vehicle 6 to avoid excessive displacements generated by rotation of the motor 60.

The method of operation is now described. When the annular helical gear 3 rotates in the direction as indicated by the arrow, if the direction adjustment rod 32 electrically contacts the negative pole of the battery connected with the end point 421 (FIG. 4) of the brush elastic plate 42, the motor 60 generates a clock-wise turn, and, meanwhile, drives the transmission gears 61, 62 to make the transverse shaft 52 move to the right and thereby makes the front wheels 22 turn to the left. The actions of the stop plate and the stop pin avoid excessive displacements generated by the motor rotation. When the direction adjustment rod 32 electrically contacts the positive pole connected with the end point 431 (FIG. 4) of the brush elastic plate 43 to make the motor 60 generate a counter-clockwise turn, then, through the transmission gears 61, 62 the transverse shaft 52 is driven to move to the left to make the front wheels 22 turn to the right. If the adjustment rod 32 does not contact the brush elastic plates 42, 43, the transverse shaft 52 is pulled back to the middle position by the spring 7, thereby causing the toy vehicle to maintain its straight travel.

In the present invention, therefore, the direction adjustment rod 32 pivotally connected with the peripheral belt 31 of the annular helical gear 3 is always adjustable to make the direction of the front wheel 22 travel changeable. More specifically, the users can adjust the direction adjustment rod 32 to change the travel route as they desire so that it is more interesting and can stimulate the players' ingenuity, which, indeed, is a highly ideal creative result.

I claim:

1. A steering control for a toy electric vehicle, wherein the vehicle includes a body, a first pair of steerable wheels which are attached to the body to rotate and move the body and which also are steerable together; a second wheel, a rotation axle for the second wheel; an electric motor drivingly connected with the second wheel for rotating the second wheel for moving the vehicle;

a disk carrying a helical gear thereon, the disk being rotatable through driving the helical gear; a worm on the rotation axle of the second wheel in driving connection with the helical gear for driving the helical gear for rotating the disk as the second wheel rotates;

electrically controllable means connected with the first wheels for selectively steering the first wheels in a first direction and in an opposite second direction as the electrically controllable means is operable between a first condition and a second condition;

a first switch connected with the electrically controllable means for being closed to operate the electrically controllable means to the first condition for steering the first wheels in the first direction;

a second switch connected with the electrically controllable means for operating the electrically controllable means to the second condition for steering the first wheels in the second direction;

at least one direction adjustment rod disposed on the disk and being mounted to rotate along with the disk, the direction adjustment rod being pivotable, relative to the disk, to at least first, second, and third positions; in its first position, the direction adjustment rod being oriented for engaging the first switch when the direction adjustment rod is rotated past that switch by the disk, in its second position, the direction adjustment rod being oriented to engage the second switch, whereby the direction adjustment rod is effective for activating the electrically controllable means to steer the first wheels in the respective one of the first and second directions dependent upon which one of the first and second switches is operated by the direction adjustment rod.

2. The steering control of claim 1, wherein there are two of the direction adjustment rods disposed on the disk, one rod oriented for contacting the first switch and the other rod oriented for contacting the second switch, and the rods are respectively so located as to contact their respective switches at different times as the disk rotates.

3. The steering control of claim 1, wherein the direction adjustment rod is secured to the disk in a manner enabling the orientation of the direction adjustment rod with respect to the disk to be adjusted for enabling the direction adjustment rod secured on the disk to selectively contact either the first switch, the second switch or none of the switches.

4. The steering control of claim 1, further comprising means connected with the first wheels for restoring the first wheels to a neutral orientation between the first and second directions when the electrically controllable means is not being operated to either the first or second conditions.

5. The steering control of claim 4, wherein the means for restoring the first wheels comprises a biasing spring connected therewith for biasing them to the neutral orientation.

6. The steering control of claim 1, wherein the electrically controllable means comprises a first electromagnet electrically connected in circuit with the first switch, a second electromagnet electrically connected with the second switch, and a permanent magnet positioned such that upon operation of the first switch, the first electromagnet is operated, and the magnetism of the first electromagnet cooperates with the magnetism of the permanent magnet to steer the first wheels in the first direction, and upon operation of the second switch, the second electromagnet is operated, and the magnetism of the second electromagnet cooperates with the magnetism of the permanent magnet to steer the first wheels in the second direction.

7. The steering control of claim 6, wherein the first and second electromagnets are supported on a common support and there is a single permanent magnet between them; the common supported is in turn connected with the first wheels, such that as the common support is moved due to operation of one of the first and second electromagnets, it steers the first wheels respectively in the first and second directions.

8. The steering control of claim 7, further comprising means connected with the first wheels for restoring the first wheels to a neutral orientation between the first and second directions when the electrically controllable means is not being operated to either the first and second conditions.

9. The steering control of claim 1, wherein the electrically controllable means comprises a second motor operable in one direction in the first condition in response to activation of the first switch and operable in a second direction in the second condition in response to activation of the second switch; a second disk including means thereon connected with the first wheels for steering the first wheels in the first direction when the second disk rotates in a third direction and for steering the first wheels in the second direction when the second disk rotates in a fourth direction; gearing connected between the second motor and the second disk for rotating the second disk in the third direction when the first switch is closed and for rotating the second disk in the fourth direction when the second switch is closed.

10. The steering control of claim 9, further comprising means connected with the first wheels for restoring the first wheels to a neutral orientation between the first and second directions when the electrically controllable means is not being operated to either the first and second conditions.

11. The steering control of claim 1, further comprising means for limiting the extent to which the first wheels may be steered in either of the first and second directions through operation of the electrically controllable means.

* * * * *